US009801453B2

(12) United States Patent
Hoag

(10) Patent No.: US 9,801,453 B2
(45) Date of Patent: Oct. 31, 2017

(54) EXOSKELETAL BACKPACK SYSTEM AND ARTICULATING CONNECTOR THEREFOR

(76) Inventor: Lance Hoag, Asheville, NC (US)

( * ) Notice: Subject to any disclaimer, the term of this patent is extended or adjusted under 35 U.S.C. 154(b) by 629 days.

(21) Appl. No.: 12/615,292

(22) Filed: Nov. 10, 2009

(65) Prior Publication Data

US 2011/0108595 A1 May 12, 2011

(51) Int. Cl.
*A45F 3/04* (2006.01)
*A45F 3/10* (2006.01)

(52) U.S. Cl.
CPC ..... *A45F 3/10* (2013.01)

(58) Field of Classification Search
USPC ..... 224/631, 637, 633, 634, 641, 635, 639, 224/628
See application file for complete search history.

(56) References Cited

U.S. PATENT DOCUMENTS

| | | | | |
|---|---|---|---|---|
| 4,303,186 | A * | 12/1981 | Ollinger, IV | 224/634 |
| 5,184,763 | A * | 2/1993 | Blaisdell et al. | 224/153 |
| 5,503,314 | A * | 4/1996 | Fiscus | 224/665 |
| 5,954,250 | A * | 9/1999 | Hall et al. | 224/262 |
| 6,089,950 | A * | 7/2000 | Lee et al. | 446/376 |
| 6,363,613 | B1 * | 4/2002 | Wolf et al. | 29/896.91 |
| 6,634,533 | B2 * | 10/2003 | Thompson et al. | 224/641 |
| 7,367,749 | B2 * | 5/2008 | Kim | 405/186 |
| 2008/0164293 | A1 * | 7/2008 | Foissac et al. | 224/633 |

FOREIGN PATENT DOCUMENTS

WO WO 2008089128 A2 * 7/2008

* cited by examiner

*Primary Examiner* — Nathan J Newhouse
*Assistant Examiner* — Matthew Theis

(57) ABSTRACT

An exoskeletal backpack system includes a pelvic superstructure, a trunk superstructure, and an articulating connector. The pelvic superstructure is configured to be carried by a user, such as, for example, a person. The trunk superstructure also includes a user engagement element that is configured as a pair of flexible composite shoulder extensions.

19 Claims, 10 Drawing Sheets

EXOSKELETAL BACKPACK SYSTEM AND ARTICULATING CONNECTOR THEREFOR

The present invention relates to an exoskeletal backpack system and an articulating connector therefor.

BACKGROUND OF THE INVENTION

Internal frame backpack systems consist of no external framework, rather a variety of semi-flexible inner structures (rod, strut or sheet) are incorporated within the back of the pack with the intention to support or direct the axial load to the lower spine, pelvis, or hips/thighs. However, in actuality a much greater percentage of the axial load is directed to the upper spine, shoulders and neck anatomy as the load typically hangs from the user's shoulders. This is due to the lacking or inefficient system of support by the backpack and the internal framing to direct the axial loads away from the upper anatomy to the more preferable lower spinal, pelvic/hip anatomy. Due to reduced system rigidity, movements and ranges-of-motions of the user may be minimally improved compared to the external frame system, however, the improvement comes at the cost of efficient load support. Given the greatly reduced efficiency and capabilities of load support of the internal frame system, the gear and items that make up the load within the backpack must be packed tightly in an effort to increase interior pressures or tensions to improve support as well as stability. This is only minimally effective and has the negative results of increased wear to the pack materials, and the gear and items that make up the load. The internal frame systems are typically of reduced durability and weight compared to the external frame systems. Internal frame systems typically hang close to the user, impeding airflow, resulting in moisture and heat retention. U.S. Pat. No. 4,479,595 to Opsal discloses an internal backpack with an internal central vertical stay of which is attached at the distal end to a free floating waist band that allows for triplanar motion (frontal/sagittal/transverse). Motion is achieved via the flexible nature of the connector fabric.

U.S. Pat. No. 6,070,776 to Furnary discloses an internal frame backpack in which the length of the shoulder straps automatically adjust to length when the wearer twists his or her torso, thereby allowing limited torso transverse plane (axial rotation) motion. Additionally, the elastic nature of the shoulder straps allows unilateral shoulder/arm motion in the superior direction.

External frame backpack systems consist of an outer frame to which the pack bags are attached. External frame systems are quite rigid. This allows for the ideal of increased support of the load by directing the axial load forces specifically to the lower spinal, pelvic/hip architecture. This results in the support of the axial load by the larger and stronger bony and muscular anatomy of the lower spine, pelvis and hips/thighs, rather than the smaller, weaker upper spinal, shoulder, and neck anatomy. The high rigidity of the frame materials allows greater stability of the load compared to internal frame backpacks. In addition, greater load capacities are possible, due to the high-strength and high-durability of the frame materials when compared to internal frame systems. The rigidity of the external frame system, however, also functions to limit the normal movements and ranges-of-motions of the user during use. The natural dynamics and kinesiology of the user during ambulation are forced to fight the opposing dynamics and strength and rigidity of the external frame. This requires greatly increased energy expenditures by the user, resulting in greatly reduced speed, endurance, comfort and overall satisfaction of the experience. The external frame system is typically of greater weight when compared to the internal frame system. U.S. Pat. No. 5,184,763 to Blaisdell et al discloses a backpack system having upper and lower modules that are connected by a three-axes ball joint assembly. This joint assembly permits free movement of the hips relative to the shoulders in all directions while transmitting the load to the hips.

The external framework and packs are held away from the user, allowing improved airflow, thus improved dryness and heat escape when compared to the internal frame system. Although internal frame backpack systems and external frame backpack systems provide improved loading distribution relative to non-self supporting fabric backpack having no frame, there is still a need for a backpack system that optimally ensures that the load is directed to the user's lower anatomy, which is the portion of the user's anatomy best suited for load support.

SUMMARY OF THE INVENTION

The riser system of the present invention is configured to allow normal movements and ranges-of-motions while the load is directed to the user's lower anatomy best suited for load support. The dynamics of the loaded backpack are isolated from the dynamics of the user's body, thereby dramatically reducing the user's energy expenditures to control, contain or overpower the load's movements, moments and oscillations during ambulation. The load is uniquely allowed to have the dynamics that physics requires of it, but without sacrificing the normal gait mechanics and dynamics of the user, or overburdening the user with excessive energy demands to overcome the load's opposing forces.

The riser system of the present invention incorporates high-tech composite superstructures that are extremely lightweight, high in strength/durability, and high in load capacity. The strategically variable flexibility/rigidity of the superstructures combined with triplanar (frontal, sagittal, transverse planes) pelvic articulation and shoulder extensions allows the user to function independently from the loaded backpack with unencumbered kinesiology and unprecedented body mobility and ranges-of-motions, while retaining high stability of the load. Unique design features of the Riser system of the present invention, including moisture and heat escape, and elimination of isolated points of pressure, ensure maximized comfort. Novel modular pack bag designs allow greatly improved ease of use and customization for the immediate need.

The riser system of the present invention is designed to allow a high degree of customization of the system's fit, level of support, load capacity, and flexibility/rigidity characteristics according to each individual use. This allows the riser system of the present invention to function ideally across many different uses and demands.

The riser system of the present invention preferably incorporates suitable materials, including, for example, pre-impregnated carbon fiber for high strength to weight ratio, controlled flexibility/rigidity, and energy storage and return properties.

According to one aspect of the present invention, there is provided a riser system which includes a base portion. The base portion is configured to be carried by a user. A supported portion is also included. The supported portion includes a user engagement element which is at a spacing from the articulating connector in a riser direction perpendicular to the lateral direction. An articulating connector is also provided. The supported portion is mounted to the base portion by the articulating connector for articulated movement of the supported portion relative to the base portion. The base portion is connected to the articulating connector at a base connection location and the supported portion is connected to the articulating connector at a riser connection location. The base connection location and the riser connection location are spaced from one another in a lateral direction. The articulating connector has a riser plane passing therethrough that is perpendicular to the lateral direction and passes through the articulating connector between the base connection location and the riser connection location such that the base connection location is on one lateral side of the riser plane and the riser connection location is on an opposite lateral side of the riser plane. The articulating connector mounts the supported portion to the base portion for articulated movement of the supported portion relative to the base portion in a manner that permits movement of the supported portion relative to the base portion about a tilt axis perpendicular to the lateral direction and the riser direction and parallel to the riser plane, movement of the supported portion relative to the base portion about a yaw axis perpendicular to the riser plane and the tilt axis, and movement of the supported portion relative to the base portion about an slew axis parallel to the riser plane and perpendicular to the tilt axis and the yaw axis. The user engagement element extends laterally relative to the riser plane to the same one lateral side of the riser plane on which the base connection location is located.

In accordance with a further feature of the one aspect of the present invention, the supported portion is configured as a trunk superstructure and the base portion is configured as a pelvic superstructure.

In accordance with a further additional feature of the one aspect of the present invention, the user engagement element is configured as a pair of flexible composite shoulder extensions.

In accordance with yet a further additional feature of the one aspect of the present invention, the base portion of the riser system is configured as a pelvic superstructure and the pelvic superstructure includes a buckle and a pair of pelvic straps together forming a pelvic band.

In accordance with another further additional feature of the one aspect of the present invention, the pelvic superstructure includes left and right halves that are overlap-hinged at a hinge.

In accordance with yet another further additional feature of the one aspect of the present invention, the articulating connector is configured as a triplanar pelvic articulation in the form of two rings, one within the other at a ninety degree (90°) offset to each other.

In accordance with a further additional feature of the one aspect of the present invention, the articulating connector includes an internal bumper formed of an elastomer material and disposed inwardly of the two rings.

In accordance with yet a further additional feature of the one aspect of the present invention, the two rings are configured as two polyvinylchloride (PVC) tubing rings.

In accordance with another further additional feature of the one aspect of the present invention, the pelvic superstructure includes a sacral pad and subscapular pads of closed cell padding.

In accordance with yet a further additional feature of the one aspect of the present invention, the riser system includes a plurality of pack bags, the trunk superstructure includes shoulder extensions and a plurality of lateral ribs, and the plurality of pack bags is secured to the shoulder extensions and the plurality of lateral ribs.

In accordance with another additional feature of the one aspect of the present invention, the articulating connector includes a restoring element. The restoring element is in an equilibrium standby condition when the supported portion is in an initial position relative to the base portion. Movement of the supported portion about the tilt axis relative to the base portion results in movement of the supported position out of its initial position relative to the base portion and subjects the restoring element to a loading that shifts the restoring element out of its equilibrium standby condition. The restoring element operates with a bias to return to its equilibrium condition as a result of which the restoring element urges the supported portion to return to its initial condition relative to the base portion.

According to an additional aspect of the present invention, there is provided a backpack system which includes a pack portion defining a volume in which items can be retained and a frame assembly which includes a base portion. The base portion is configured to be carried by a user. The backpack system also includes a supported portion. The supported portion includes a user engagement element and an articulating connector. The articulating connector mounts the supported portion to the base portion for articulated movement of the supported portion relative to the base portion. The base portion is connected to the articulating connector at a base connection location and the supported portion is connected to the articulating connector at a riser connection location. The base connection location and the riser connection location are spaced from one another in a lateral direction. The user engagement element is at a spacing from the articulating connector in a riser direction perpendicular to the lateral direction and the articulating connector having a riser plane extending therethrough that is perpendicular to the lateral direction and passes through the articulating connector between the base connection location and the riser connection location such that the base connection location is on one lateral side of the riser plane and the riser connection location is on an opposite lateral side of the riser plane. The articulating connector mounts the supported portion to the base portion for articulated movement of the supported portion relative to the base portion in a manner permitting movement of the supported portion relative to the base portion about a tilt axis perpendicular to the lateral direction and the riser direction and parallel to the riser plane, movement of the supported portion relative to the base portion about a yaw axis perpendicular to the riser plane, and movement of the supported portion relative to the base portion about an slew axis extending along the riser direction parallel to the riser plane and perpendicular to the lateral direction. The user engagement element extends laterally of the riser plane on the one lateral side of the riser plane to which the base connection location is located.

According to a further aspect of the present invention, there is provided a riser system which includes a base portion. The base portion is configured to be carried by a user. A supported portion and an articulating connector are also provided. The articulating connector mounts the supported portion to the base portion for articulated movement of the supported portion relative to the base portion. The base portion is connected to the articulating connector at a base connection location and the supported portion is connected to the articulating connector at a riser connection location. The base connection location and the riser connection location are spaced from one another in a lateral direction. The articulating connector has a riser plane passing therethrough that is perpendicular to the lateral direction and passes through the articulating connector between the base connection location and the riser connection location such that the base connection location is on one lateral side of the riser plane and the riser connection location is on an opposite lateral side of the riser plane. The articulating connector mounts the supported portion to the base portion for articulated movement of the supported portion relative to the base portion in a manner that permits movement of the supported portion relative to the base portion about a tilt axis perpendicular to the lateral direction and the riser direction and parallel to the riser plane, movement of the supported portion relative to the base portion about a yaw axis perpendicular to the riser plane and the tilt axis, and movement of the supported portion relative to the base portion about an slew axis parallel to the riser plane and perpendicular to the tilt axis and the yaw axis. The articulating connector includes a restoring element. The restoring element is in an equilibrium standby condition when the supported portion is an initial position relative to the base portion. Movement of the supported portion about the tilt axis relative to the base portion results in movement of the supported portion out of its initial position relative to the base portion and subjects the restoring element to a loading that shifts the restoring element out of its equilibrium standby condition. The restoring element operates with a bias to return to its equilibrium condition as a result of which the restoring element urges the supported portion to return to its initial condition relative to the base portion.

In accordance with a further feature of the further aspect of the present invention, the supported portion includes a user engagement element. The user engagement element is at a spacing from the articulating connector in the riser direction and the user engagement element extends laterally relative to the riser plane to the same one lateral side of the riser plane on which the base connection location is located.

BRIEF DESCRIPTION OF THE DRAWINGS

An embodiment of the present invention is hereinafter described with reference to the figures of the drawings as follows.

DETAILED DESCRIPTION OF THE PREFERRED EMBODIMENT

Figure 1:
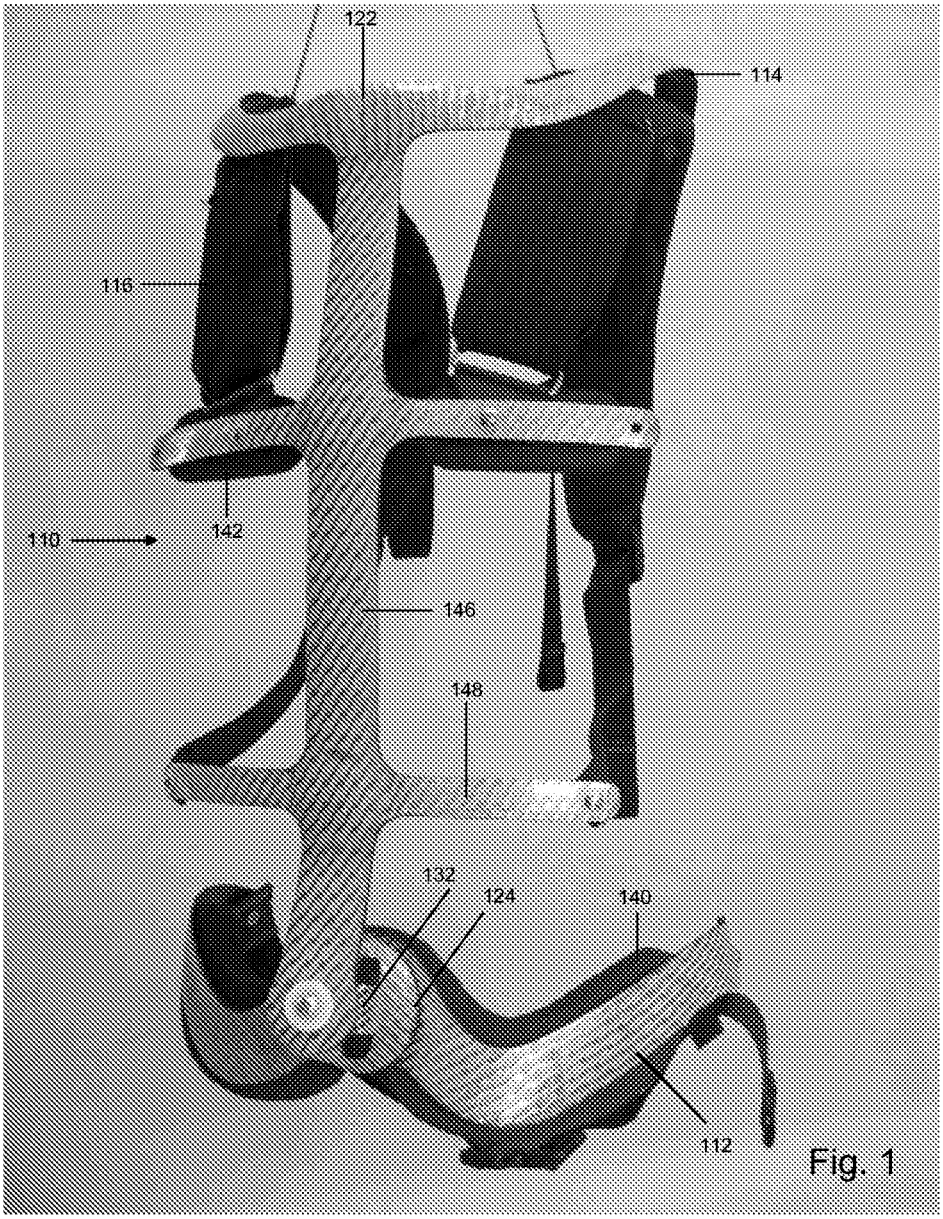
FIG. 1 is a rear perspective view of one embodiment of the riser system of the present invention.
Figure 2:
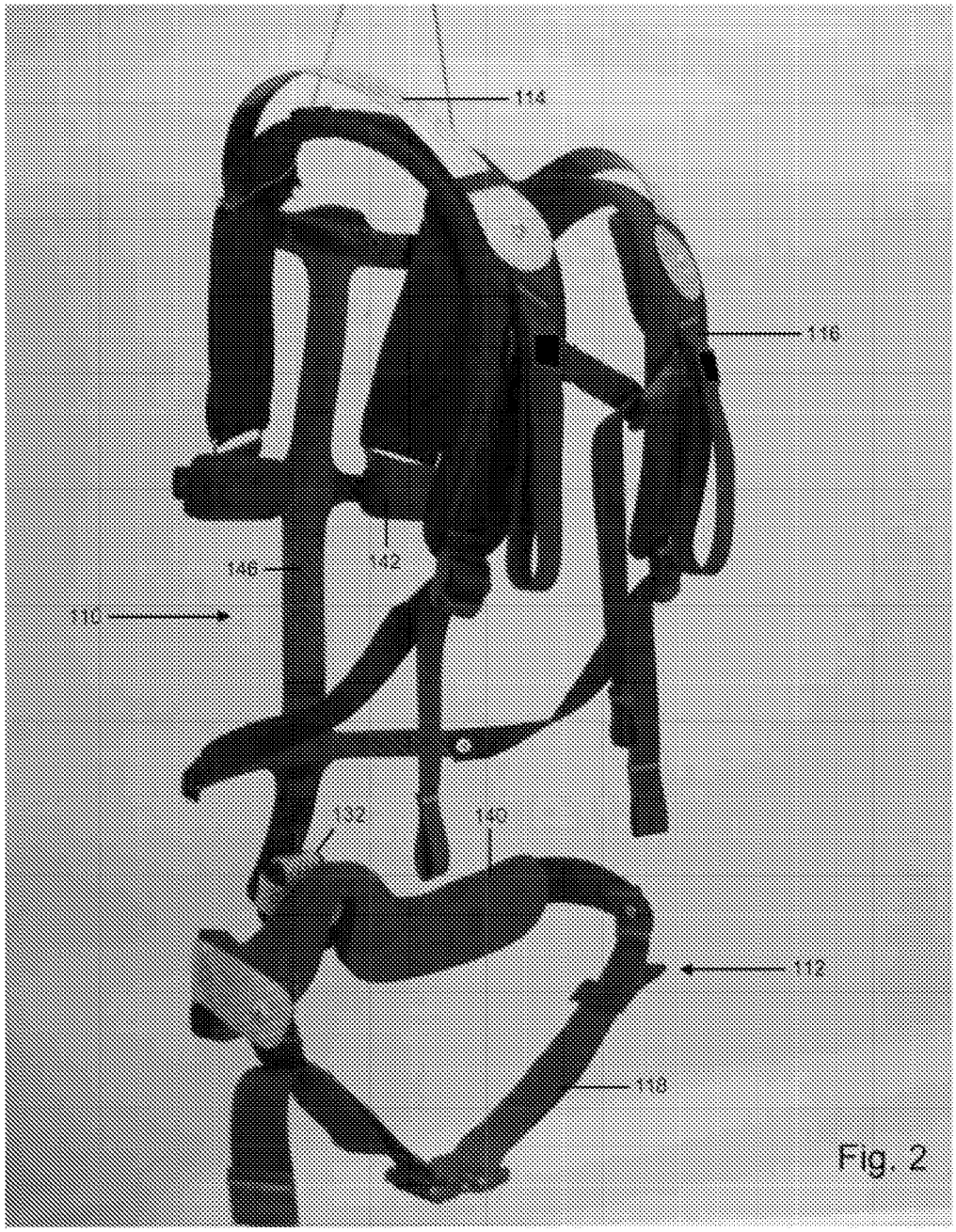
FIG. 2 is a front perspective view of the one embodiment of the riser system of the present invention.
Figure 3:
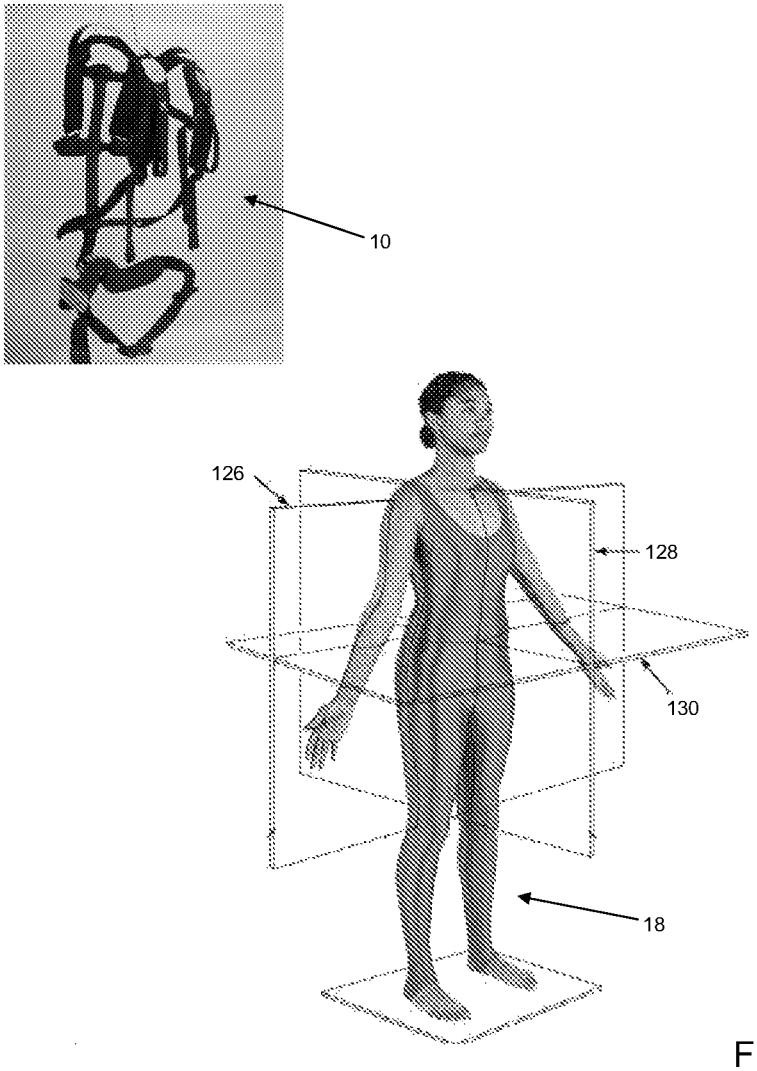
FIG. 3 is a perspective view of the one embodiment of the riser system of the present invention in a ready state for donning by a system user and showing a system user in a posture for donning the riser system.
Figure 4:
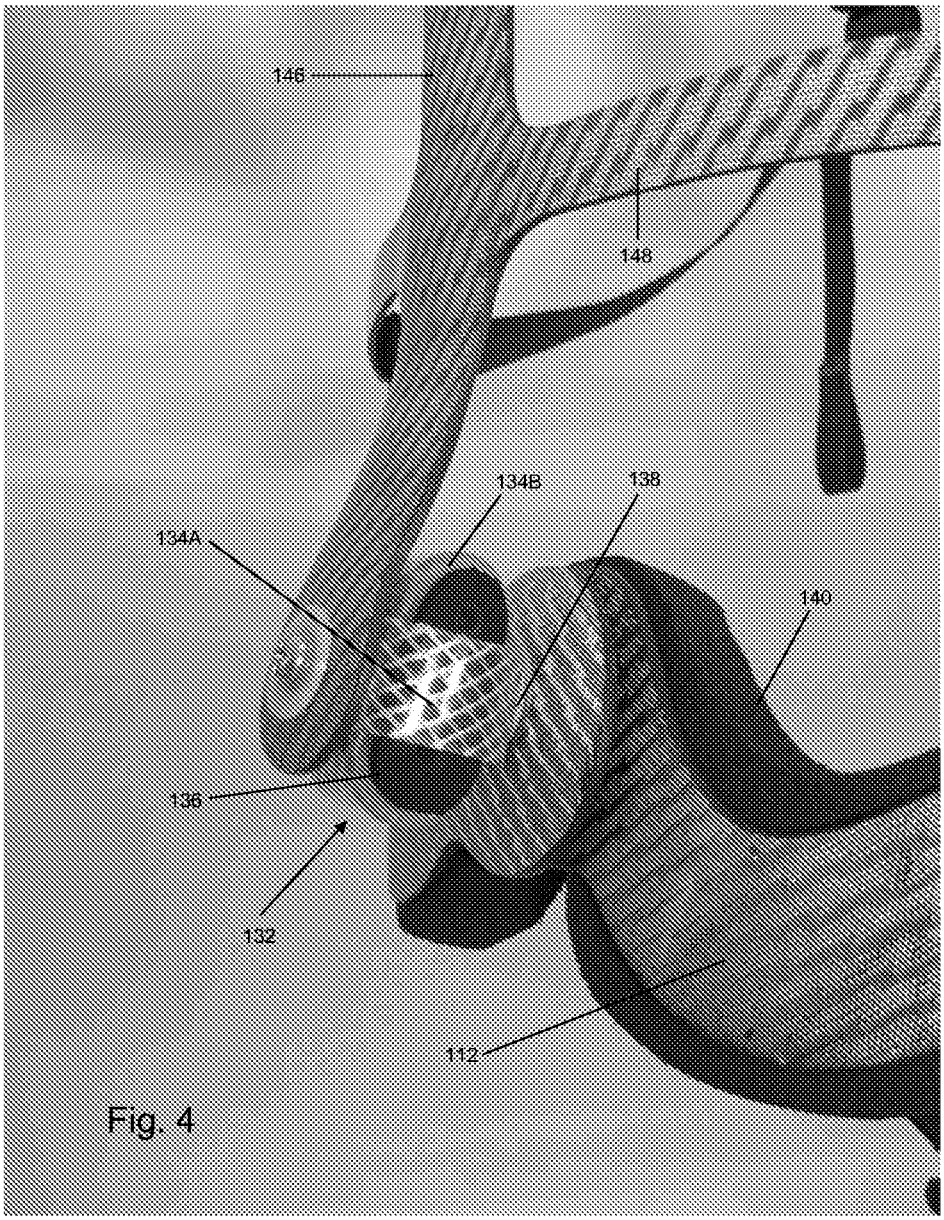
FIG. 4 is an enlarged rear perspective view of one portion of the one embodiment of the riser system of the present invention.
Figure 5:
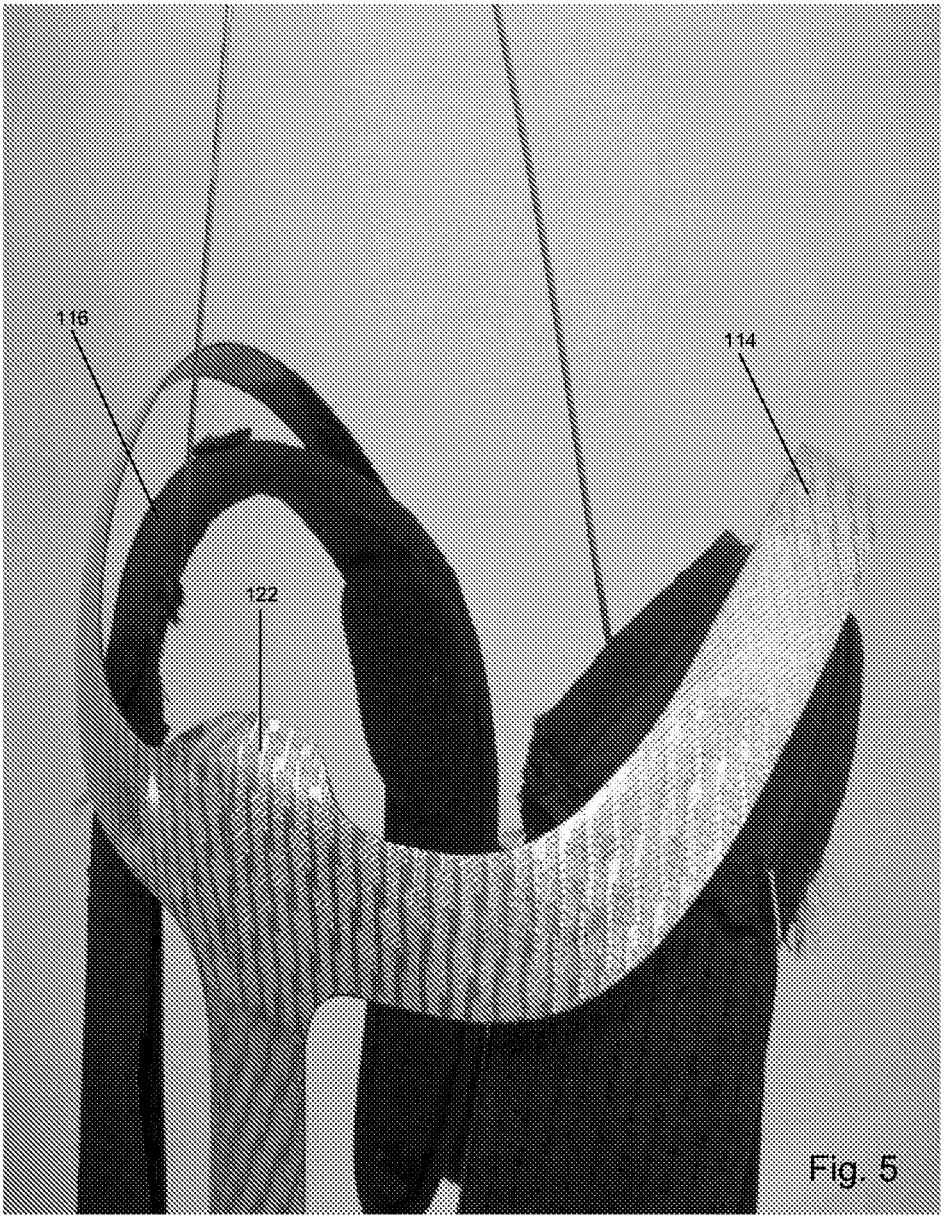
FIG. 5 is an enlarged rear perspective view of another portion of the one embodiment of the riser system of the present invention.
Figure 6:
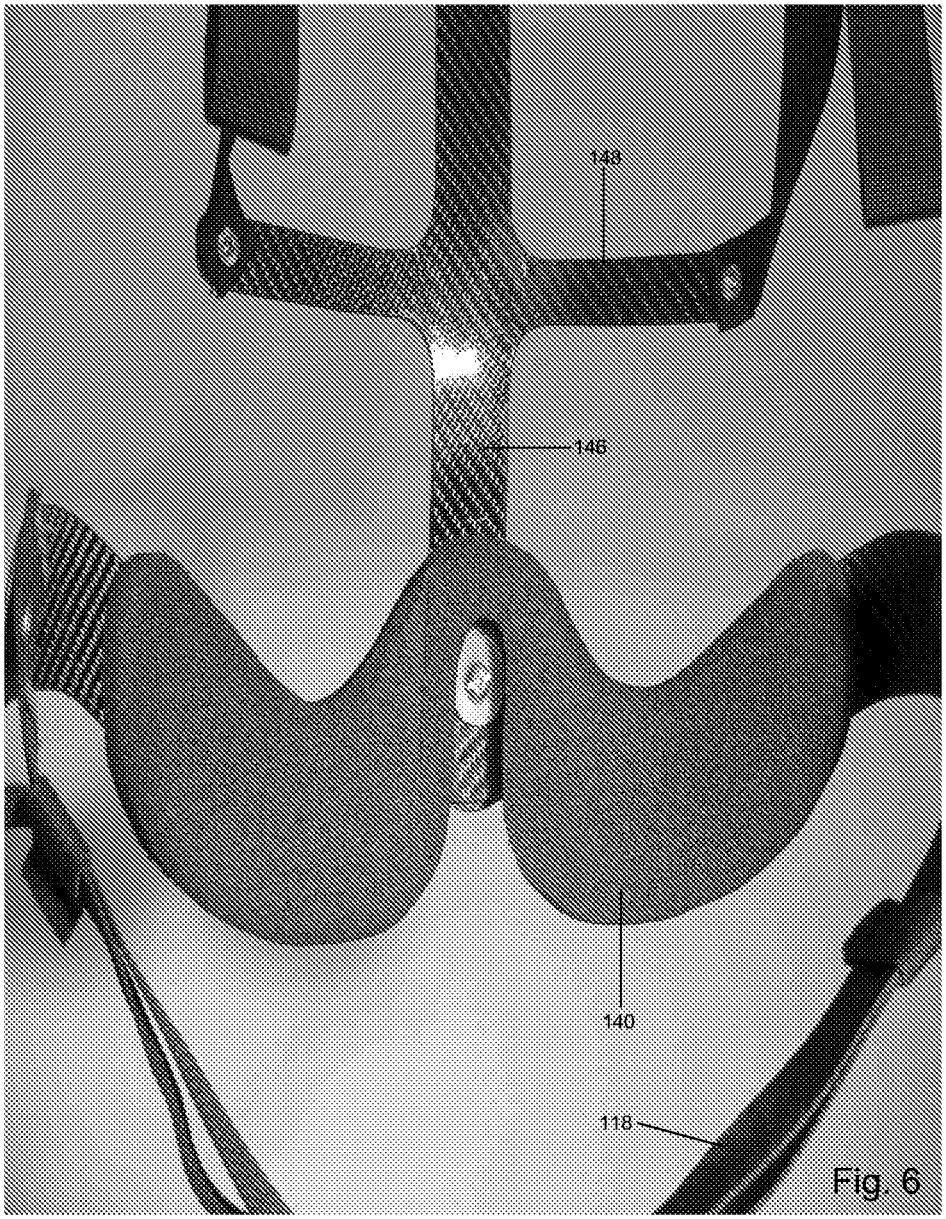
FIG. 6 is an enlarged front perspective view of a further portion of the one embodiment of the riser system of the present invention.
Figure 7:
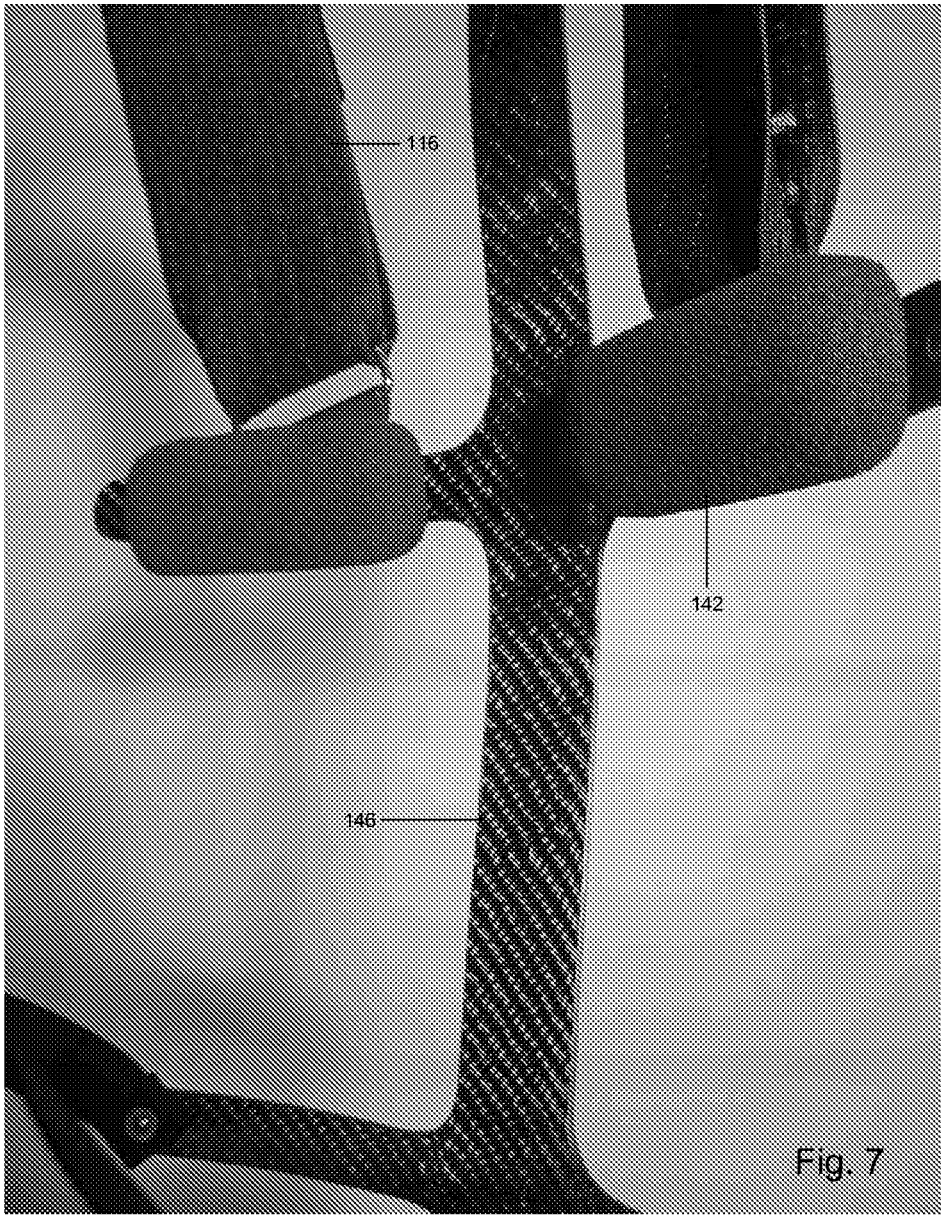
FIG. 7 is an enlarged front perspective view of an additional portion of the one embodiment of the riser system of the present invention.
Figure 8:
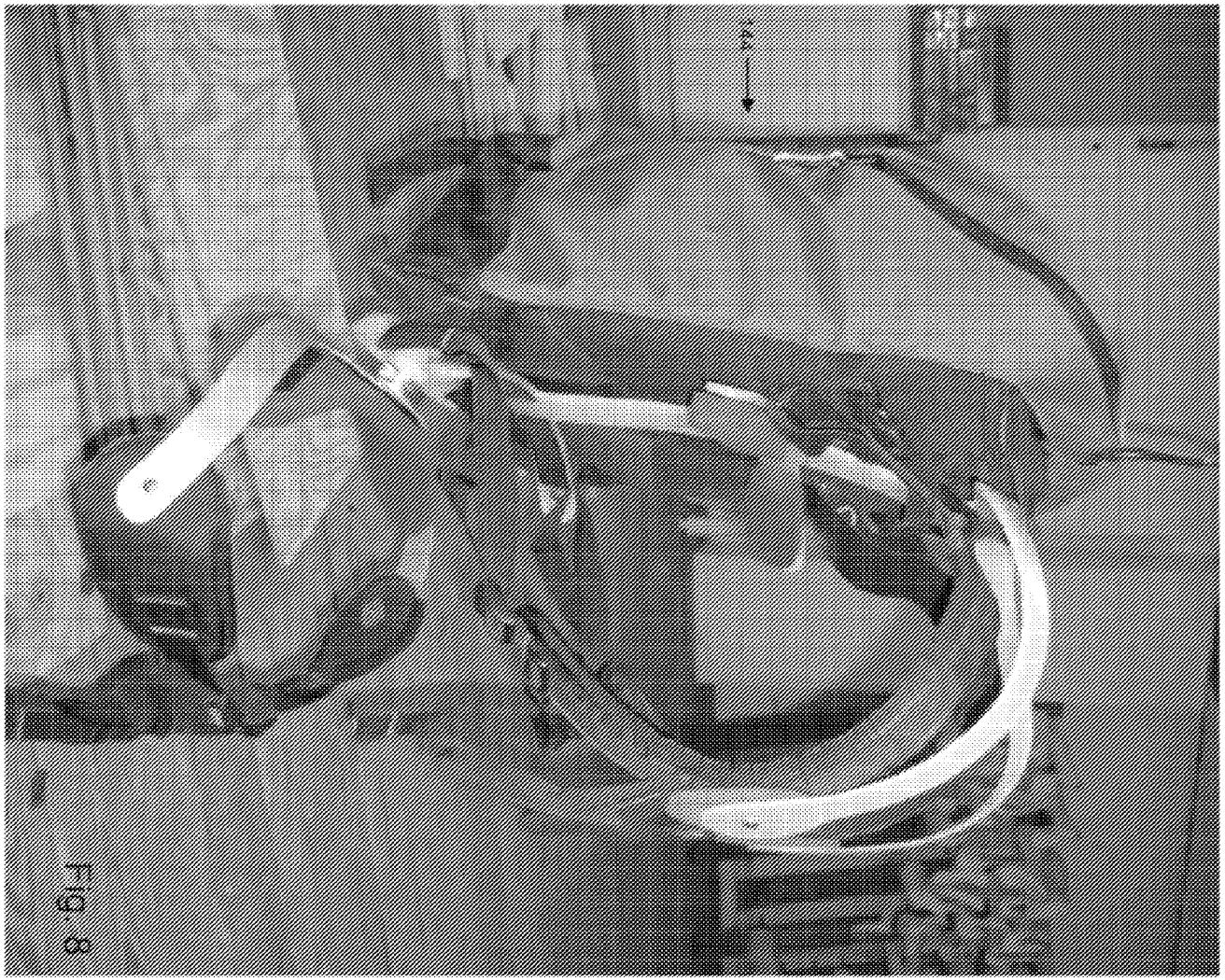
FIG. 8 is a side perspective view of the one embodiment of the riser system of the present invention with the pack modules shown.
Figure 9:
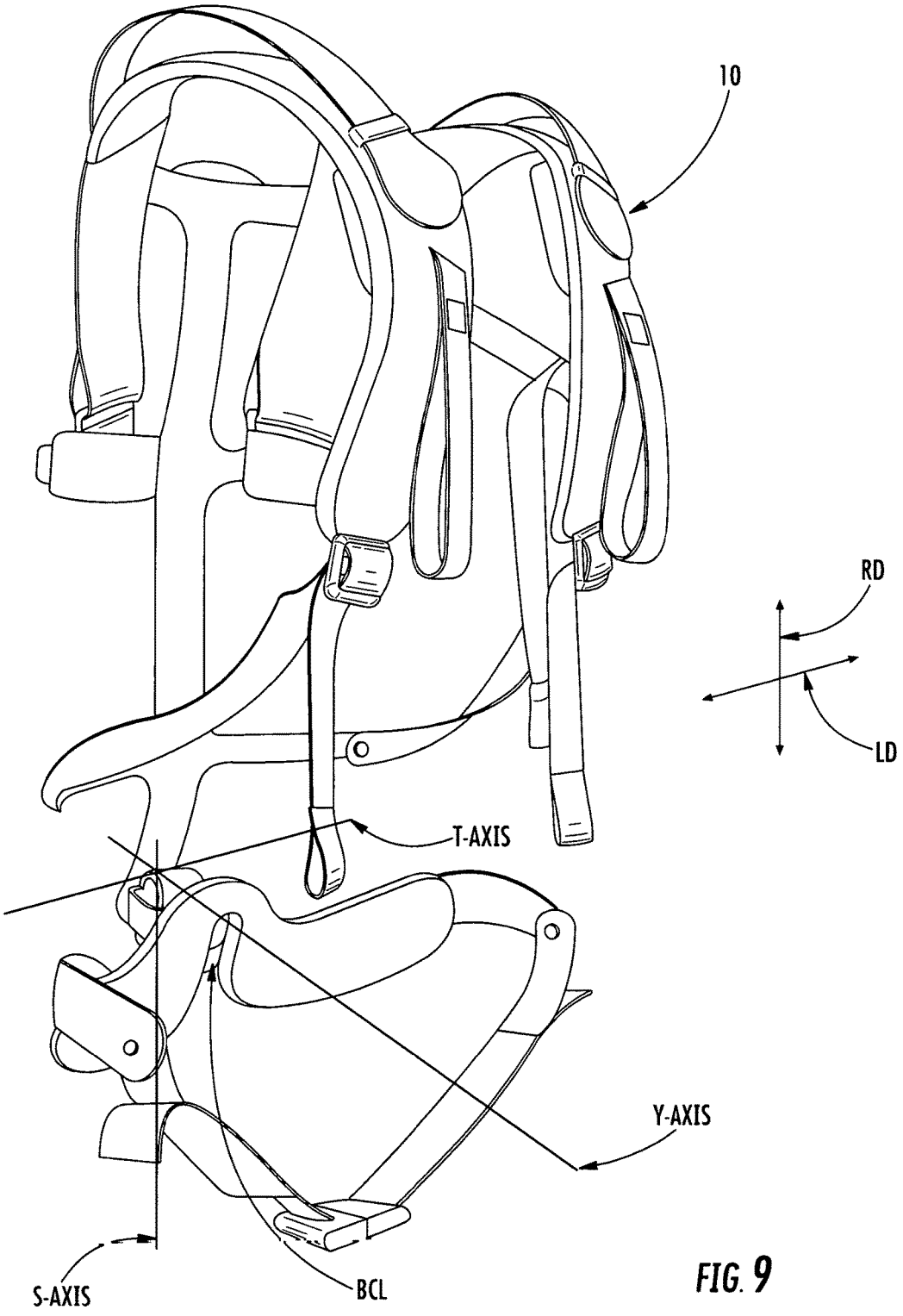
FIG. 9 is a front perspective view of the one embodiment of the riser system of the present invention.

As seen in FIGS. 1-10, one embodiment of the riser system of the present invention is generally designated as the riser system 10 and includes a base portion 12, a supported portion 14, and an articulating connector 16. The base portion 12 is configured to be carried by a user, such as, for example, a person generally designated as a system user 18 as seen in FIG. 3 or a load-bearing animal.

The supported portion 14 is configured as a trunk superstructure 110 and the base portion 12 is configured as a pelvic superstructure 112. The supported portion 14 also includes a user engagement element 20 that is configured as a pair of flexible composite shoulder extensions 114. The articulating connector 16 mounts the supported portion 14 to the base portion 12 for articulated movement of the supported portion 14 relative to the base portion 12. The base portion 12 is connected to the articulating connector 16 at a base connection location BCL and the supported portion 14 is connected to the articulating connector 16 at a riser connection location RCL. The base connection location BCL and the riser connection location RCL are spaced from one another in a lateral direction LD. The user engagement element 20 is at a spacing from the articulating connector 16 in a riser direction RD perpendicular to the lateral direction LD.

A riser plane R-Plane passes through the articulating connector 16 and is perpendicular to the lateral direction LD. The riser plane R-Plane passes through the articulating connector 16 between the base connection location BCL and the riser connection location RCL such that the base connection location BCL is on one lateral side of the riser plane R-Plane and the riser connection location RCL is on an opposite lateral side of the riser plane R-Plane. The articulating connector 16 mounts the supported portion 14 to the base portion 12 for articulated movement of the supported portion 14 relative to the base portion 12 in a manner permitting movement of the supported portion 14 relative to the base portion 12 about a tilt axis T-Axis perpendicular to the lateral direction LD and the riser direction RD and parallel to the riser plane R-Plane, movement of the supported portion 14 relative to the base portion 12 about a yaw axis Y-Axis perpendicular to the riser plane R-Plane and the tilt axis T-Axis, and movement of the supported portion 14 relative to the base portion 12 about a slew axis S-Axis parallel to the riser plane R-Plane and perpendicular to the tilt axis T-Axis and the yaw axis Y-Axis. The user engagement element 20 extends laterally relative to the riser plane R-Plane on the same one lateral side of the riser plane R-Plane on which the base connection location BCL is located.

The user engagement element 20 includes a pair of flexible composite shoulder extensions 114 each having a shoulder strap 116 connected to the trunk superstructure 110 at a spacing from the riser connection location RCL. The pelvic superstructure 112 includes a buckle and pair of pelvic straps 118 together forming a pelvic band. The trunk superstructure 110 includes a removable head extension 120 that is selectively attached or detached at a spinal and shoulder yoke 122.

Pelvic articulation of the pelvic superstructure 112 is two-fold. A left band and right band of the pelvic superstructure 112 are overlap-hinged at a hinge 124 in the sacral area of the user 18 and each band can pivot relative to the other band for selectively abduction or adduction adjustment for customized fit of a user's pelvic and hip anatomy. The connection location of the collective bilateral pelvic band 112 and spinal aspect of the trunk superstructure 110 is designed to maximize the simultaneous dynamic ranges-of-motion of the pelvis and trunk in a frontal and coronal plane (lateral flexion and extension) 126, a sagittal plane (anterior and posterior flexion and extension) 128, and a transverse plane (axial rotation) 130 defined relative to the system user 18.

The articulating connector 16 is configured as a triplanar pelvic articulation in the form of a pelvic joint 132 constructed of two polyvinylchloride (PVC) tubing rings 134A, 134B, with the polyvinylchloride (PVC) tubing ring 134B being located within the ring 134A at a ninety degree (90°) offset to the ring 134B. The articulating connector 16 also includes a restoring element 136 formed of an elastomer material. The pelvic superstructure 112 includes a pelvic and sacral pad 140 and subscapular pads 142 of closed cell padding.

A plurality of pack bags 144 can be secured to the shoulder extensions 114 and to a plurality of lateral ribs 148 and a trunk superstructure spine 146 of the trunk superstructure 110. The pack bags 144 are configured as a modular system of smaller pack bags attached to the trunk superstructure ribs 148 and shoulder extension 114. The modular pack system allows the user to only carry or use the pack bags required for immediate use, allowing single day or multi-day use without carrying more backpack than is necessary. Additionally, the specific pack bag modules can be independently detached from the superstructure as is required or convenient during use. The pack modules are cuboidal or horizontally rectangular in shape, rather than the vertically rectangular orientation of several conventionally known backpacks. The horizontally oriented pack bag modules result in improved ease of entry, packing, and item location and retrieval. Pack bag module fabrics are water proof or water resistant with high abrasion and puncture and tear resistance, and elasticity.

Figure 10:
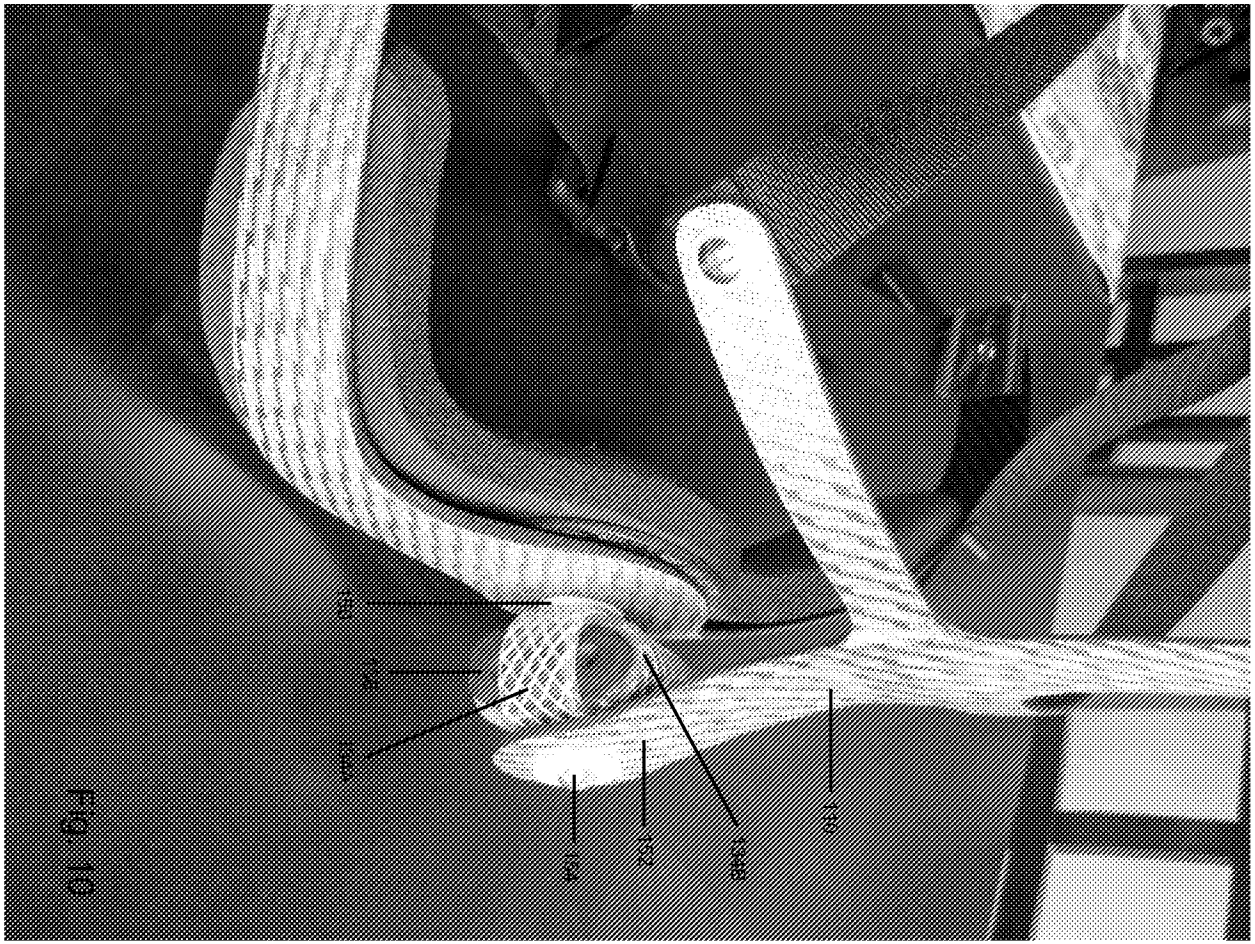
FIG. 10 is an enlarged rear perspective view of the one portion of the one embodiment of the riser system of the present invention.

The hinge 124 includes a pin that extends through the left and right bands of the pelvic superstructure 112 and, in addition to pivotally connecting the left and right bands of the pelvic superstructure 112, the hinge 124 also pivotally connects the ring 134A to the pelvic superstructure 112 and pivotally connects the ring 134A and the ring 134B to one another at an inboard location. These pivot connections are provided by the hinge 124 in that the pin of the hinge 124 extends through respective through bores in the left and right bands of the pelvic superstructure 112, the ring 134A, and the ring 134B. The respective pivot connection between the ring 134A and the left and right bands of the pelvic superstructure 112 delimits the base connection location BCL. The pivot connection between the ring 134A and the left and right bands of the pelvic superstructure 112 delimiting the base connection location BCL permits pivoting of the trunk superstructure 110 about the yaw axis Y-Axis relative to the pelvic superstructure 112. As seen in FIG. 10, a plastic washer 150 is interposed between the ring 134A and the left and right bands of the pelvic superstructure 112 to facilitate ease of pivoting.

The trunk superstructure 110 has a lower extension 152 with a through bore formed in it. A hinge 154 includes a pin that extends through respective through bores in the ring 134A and the ring 134B and the through bore in the lower extension 152 of the trunk superstructure 110, whereupon this pivot connection thereby formed delimits the riser connection RSL. The pivot connection between ring 134A, and the ring 134B and the through bore in the lower extension 152 of the trunk superstructure 110 delimiting the riser connection location RCL permits the trunk superstructure 110 to move about the tilt axis T-Axis relative to the pelvic superstructure 112 in the following manner. The restoring element 136 is, before assembly into the ring 134B, in the shape of an annular ring and this ring is deformed from its annular shape into a generally ellipsoidal shape once the restoring element 136 has been assembled into the ring 134B. Prior to use of the riser system 10 by the system user 18, the restoring element 136 is in an equilibrium standby condition. If the system user 18 disposes the riser system 10 in a user mounted disposition in which the pelvic superstructure 112 is seated generally about the waist of the system user, and if the system user 18 then assumes an erect posture in which the riser plane R-Plane passing through the articulating connector 16 is vertical, a line extending through the pivot connection between the ring 134A and the left and right bands of the pelvic superstructure 112 delimiting the base connection location BCL trunk and the pivot connection between ring 134A, and the ring 134B and the through bore in the lower extension 152 of the trunk superstructure 110 delimiting the riser connection location RCL will be a horizontal line.

As a result of its elastomer material, the restoring element 136, when in its assembled condition in the ring 134B, imparts a radially outward biasing force against the ring 134B. In the event, for example, the pack bags 144 are loaded, the now-heavier pack bags 144 apply a force in the riser direction (i.e., downwardly) on the trunk superstructure 110 at its lower extension 152 that, in turn, imposes a downward loading on the hinge 154. When the system user 18 disposes the riser system 10 in a user mounted disposition in which the pelvic superstructure 112 is seated generally about the waist of the system user, the trunk superstructure 110 assumes an initial position with respect to the pelvic superstructure 112 relative to the tilt axis T-Axis. In the further event that the riser system 10 is now carried by the user 18 and the hips of the system user 18 then tilt relative to the torso of the system user (in other words, the system user 18 bends at the waist), there is a corresponding relative movement between the trunk superstructure 110 and the pelvic superstructure 112 about the tilt axis T-Axis. This relative movement between the trunk superstructure 110 and the pelvic superstructure 112 about the tilt axis T-Axis results in the trunk superstructure 110 leaving its initial position with respect to the pelvic superstructure 112 relative to the tilt axis T-Axis and assuming an in-use displaced position with respect to the pelvic superstructure 112 relative to the tilt axis T-Axis. Additionally, this relative movement between the trunk superstructure 110 and the pelvic superstructure 112 about the tilt axis T-Axis subjects the restoring element 136 to a compressive force that causes compression of the elastomer material against the outward radial bias of this material. Accordingly, the elastomer material of the restoring element 136 biases the restoring element 136 to return from this in-use deformed condition to its equilibrium standby condition, whereupon the restoring element 136 exerts a force on the trunk superstructure 110 to return from its in-use displaced position with respect to the pelvic superstructure 112 relative to the tilt axis T-Axis to its initial position with respect to the pelvic superstructure 112 relative to the tilt axis T-Axis.

The trunk 110 and pelvic 112 superstructures are designed to maximize axial load transference to the lumbosacral-pelvic architecture, thus minimizing or eliminating loading of the trunk and upper body. The flexible composite shoulder extensions 114 function to provide structural support for the shoulder strap 116. The inverted hammock design and elastic properties of the shoulder strap system ensure minimal or no axial loading of the thoracic and cervical spine and shoulder girdle, and maximized mobility of the shoulder complex and arms. A pelvic strap 118 and buckle are attached to the anterior aspect of the pelvic band. A removable head extension 120 is selectively attached or detached at the point of the spinal and shoulder yoke 122. This allows increased load volume capabilities, but is removable when not needed, providing a lighter backpack weight and reduced backpack profile for snagging on branches or vegetation.

Pelvic articulation is two-fold. The left and right halves of the pelvic band 112 are overlap-hinged 124 in the sacral area for selectively abduction or adduction adjustment for customized fit of user's pelvic and hip anatomy. The connection of the collective bilateral pelvic bands 112 and spinal aspect of the trunk superstructure 110 is designed to maximize the simultaneous dynamic ranges-of-motion of the pelvis and trunk in the frontal and coronal plane (lateral flexion and extension) 126, sagittal plane (anterior and posterior flexion and extension) 128, and transverse plane (axial rotation) 130. This unprecedented freedom of motion results in greatly minimized resistance of the user's dynamic gait mechanics by the backpack superstructure and load, improving energy expenditures, biomechanical efficiency and endurance, and user comfort. The triplanar pelvic articulation is provided by a pelvic joint 132 constructed of two polyvinylchloride (PVC) tubing rings 134, one within the other at a ninety degree (90°) offset (horizontal and vertical orientations), with or without internal bump and elastomer 136 according to pack load and desired level of flexibility, shock absorption and vibration dampening, and synthetic material washers 138 to reduce resistance of pelvic and spinal lateral flexion. The pelvic joint 132 is highly customizable to match the load carrying and vibration dampening characteristics desired due to the several ways in which the joint can be configured.

The pelvic 118 and shoulder 116 strapping systems incorporate elastic mesh, nylon and Dacron webbing, snap buckles and thin padding to ensure light weight and minimal materials, maximized breath-ability and prevention of water or moisture retention to provide maximum comfort through dryness, cooling and pressure relief. The uniquely elastic nature of the shoulder straps allows greatly improved upper arm and shoulder mobility and isolation of the backpack dynamics from the user's upper body. The pelvic and sacral pad 140 and subscapular pads 142 of closed cell padding with high cushion value control pressures and ensure comfort without retaining water or moisture.

The "riser" system ensures airflow, as a space is always maintained between the user and pack bags 144 by the trunk superstructure spine 146, shoulder extensions 114, and lateral ribs 148, thereby maximizing breath-ability, dryness and cooling effects. The Riser system of the present invention incorporates a modular system of smaller pack bags 150 attached to the trunk superstructure ribs 148 and shoulder extension 114. The modular pack system allows the user to only carry or use the pack bags required for the immediate use, allowing single day or multi-day use without carrying more backpack than is necessary. Additionally, the specific pack bag modules can be independently detached from the superstructure as is required or convenient during use. The pack modules are cuboidal or horizontally rectangular in shape, rather than the vertically rectangular orientation that is typical of current backpacks. The horizontally oriented pack bag modules result in improved ease of entry, packing, and item location and retrieval. Pack bag module fabrics are water proof or water resistant with high abrasion and puncture and tear resistance, and elasticity.

Due to the novelty of the "riser" backpack system, the three typical categories of backpacks do not apply and a new category label is required. The "external-frame" backpack category with its excessively heavy and rigid, enclosed "frame," is not appropriate, as the riser system of the present invention does not incorporate a framework, rather a more functional central spine 146 and lateral ribs 148. Most certainly, neither of "internal frame" and "frameless" backpack categories, with their inherent ineffective or inability to direct the load to the lower spine and pelvic architecture types apply.

The Riser system incorporates a single distal-posteriorly placed triplanar motion pelvic joint that articulates for full triplanar motion in the frontal, as well as sagittal (anterior and posterior flexion and extension) and transverse (axial rotation) planes, necessary to allow normal gait mechanics.

Moreover, the Riser system, incorporates a fully semi-flexible joint body that through deformation and compression simultaneously allows for sagittal and transverse motions. The Riser system mimics the natural lumbar lordosis angle in the shape of the central spine, and therefore does not require a spacer bolt. The Riser system incorporates no design features for limitations of sagittal plane motion, but rather to maximize these motions without sacrifice of load stability.

The Riser system allows for a large range of motion in the transverse plane through deformation of the semi-flexible joint body and the flexible nature of the composite central spine. This functions to maximize the natural gait mechanics of pelvic rotation during ambulation.

The Riser system incorporates removable modular pack bags that combine in a variety of configurations for optimal capacity, weight, improved organization and ease of use.

The Riser system incorporates a variably flexible spine and flexible shoulder extensions and elastic shoulder strapping to eliminate or minimize loading or stressing the muscular systems of the upper body.

The Riser system incorporates a single distal-posteriorly placed triplanar motion pelvic joint that articulates for triplanar motion in the frontal, as well as sagittal (anterior and posterior flexion and extension) and transverse (axial rotation) planes, necessary to allow normal gait mechanics. The Riser joint system uses a single, distal-posteriorly placed triplanar pelvic joint at the lumbosacral level.

The Riser pelvic joint is attached to the pelvic band, which is comprised of left and right halves combined in an overlap joint to allow for abduction and adduction to accommodate varying shapes of user hips.

The Riser system allows for triplanar motion of frontal (lateral flexion and extension), sagittal and transverse (axial rotation) plane motions of the torso section due to the variably flexible nature of the composite central spine.

The Riser system uses an elastic shoulder strapping, however a thin flexible composite extension that overlies the shoulder strap without user contact to maintain axial loading is routed through the shoulder extension, shoulder yoke, central spine to the pelvic band, rather than the shoulder strap as with this prior art. The Riser system allows full ranges of motion of the shoulder complex, but without sacrificing the directing of the load to the pelvis.

Provisions are provided for dynamic shoulder assembly motion during use apart from readjusting the shoulder assembly to different vertical setting.

There is recognition of the value of vertically stacked, horizontally oriented pack bags with the Riser system design, however the bags are attached to the frame via straps, rather than sitting on a shelf.

The Riser system utilizes an automatic adjustment for customized fit of the pelvic band to the user's anatomy, however, a single distal-posteriorly placed overlap hinge is utilized.

While an embodiment of the invention has been described and illustrated herein, it is to be distinctly understood that the invention is not limited thereto, but may be otherwise variously embodied and practiced within the scope of the following claims.

It is claimed:

1. A riser system, comprising:

a base portion, the base portion being configured to be carried by a user;

a supported portion, the supported portion including a user engagement element; and an articulating connector, the articulating connector mounting the supported portion to the base portion for articulated movement of the supported portion relative to the base portion, the base portion being connected to the articulating connector at a base connection location and the supported portion being connected to the articulating connector at a riser connection location, the base connection location and the riser connection location being spaced from one another in a lateral direction, the user engagement element being at a spacing from the articulating connector in a riser direction perpendicular to the lateral direction, and the articulating connector having a riser plane passing therethrough that is perpendicular to the lateral direction and passes through the articulating connector between the base connection location and the riser connection location such that the base connection location is on one lateral side of the riser plane and the riser connection location is on an opposite lateral side of the riser plane, the articulating connector mounting the supported portion to the base portion for articulated movement of the supported portion relative to the base portion in a manner that permits movement of the supported portion relative to the base portion about a tilt axis perpendicular to the lateral direction and the riser direction and parallel to the riser plane, movement of the supported portion relative to the base portion about a yaw axis perpendicular to the riser plane and the tilt axis, and movement of the supported portion relative to the base portion about a slew axis parallel to the riser plane and perpendicular to the tilt axis and the yaw axis, and the user engagement element extends laterally relative to the riser plane to the same one lateral side of the riser plane on which the base connection location is located, the articulating connector compressing, extending, or both compressing and extending to permit movement of the supported portion relative to the base portion about the slew axis and to permit movement of the supported portion relative to the base portion about the tilt axis and the articulating connector permitting simultaneous movement of the supported portion relative to the base portion about the slew axis and about the tilt axis.

2. The riser system according to claim 1, wherein the supported portion is configured as a trunk superstructure and the base portion is configured as a pelvic superstructure.

3. The riser system according to claim 1, wherein the user engagement element that is configured as a pair of flexible composite shoulder extensions.

4. The riser system according to claim 1, wherein the pelvic superstructure includes left and right halves that are overlap-hinged at a hinge.

5. The riser system according to claim 1, wherein the articulating connector is configured as a triplanar pelvic articulation in the form of two rings, one within the other at a ninety degree(90°) offset.

6. The riser system according to claim 5, wherein the two rings are configured as two polyvinylchloride (PVC) tubing rings.

7. The riser system according to claim 4, wherein the pelvic superstructure includes a sacral pad and subscapular pads of closed cell padding.

8. The riser system according to claim 2 and further comprising a plurality of pack bags, the trunk superstructure includes shoulder extensions and a plurality of lateral ribs and the plurality of pack bags is secured to the shoulder extensions and the plurality of lateral ribs.

9. The riser system according to claim 1, wherein the articulating connector includes a restoring element, the restoring element being in an equilibrium standby condition when the supported portion is in an initial position relative to the base portion, movement of the supported portion about the tilt axis relative to the base portion results in movement of the supported position out of its initial position relative to the base portion and subjects the restoring element to a loading that shifts the restoring element out of its equilibrium standby condition, and the restoring element operates with a bias to return to its equilibrium condition as a result of which the restoring element urges the supported portion to return to its initial condition relative to the base portion.

10. A backpack system comprising:

a pack portion defining a volume in which items can be retained; and a frame assembly including a base portion, the base portion being configured to be carried by a user, a supported portion, the supported portion including a user engagement element, and an articulating connector, the articulating connector mounting the supported portion to the base portion for articulated movement of the supported portion relative to the base portion, the base portion being connected to the articulating connector at a base connection location and the supported portion being connected to the articulating connector at a riser connection location, and the base connection location and the riser connection location being spaced from one another in a lateral direction, the user engagement element is at a spacing from the articulating connector in a riser direction perpendicular to the lateral direction and the articulating connector having a riser plane extending therethrough that is perpendicular to the lateral direction and passes through the articulating connector between the base connection location and the riser connection location such that the base connection location is on one lateral side of the riser plane and the riser connection location is on an opposite lateral side of the riser plane, the articulating connector mounting the supported portion to the base portion for articulated movement of the supported portion relative to the base portion in a manner permitting movement of the supported portion relative to the base portion about a tilt axis perpendicular to the lateral direction and the riser direction and parallel to the riser plane, movement of the supported portion relative to the base portion about a yaw axis perpendicular to the riser plane, and movement of the supported portion relative to the base portion about a slew axis extending along the riser direction parallel to the riser plane and perpendicular to the lateral direction, and the user engagement element extending laterally of the riser plane on the one lateral side of the riser plane to which the base connection location is located, the articulating connector compressing, extending, or both compressing and extending to permit movement of the supported portion relative to the base portion about the slew axis and to permit movement of the supported portion relative to the base portion about the tilt axis and the articulating connector permitting simultaneous movement of the supported portion relative to the base portion about the slew axis and about the tilt axis.

11. A riser system, comprising:

a base portion, the base portion being configured to be carried by a user;

a supported portion; and an articulating connector, the articulating connector mounting the supported portion to the base portion for articulated movement of the supported portion relative to the base portion, the base portion being connected to the articulating connector at a base connection location and the supported portion being connected to the articulating connector at a riser connection location, the base connection location and the riser connection location being spaced from one another in a lateral direction, and the articulating connector having a riser plane passing therethrough that is perpendicular to the lateral direction and passes through the articulating connector between the base connection location and the riser connection location such that the base connection location is on one lateral side of the riser plane and the riser connection location is on an opposite lateral side of the riser plane, the articulating connector mounting the supported portion to the base portion for articulated movement of the supported portion relative to the base portion in a manner that permits movement of the supported portion relative to the base portion about a tilt axis perpendicular to the lateral direction and the riser direction and parallel to the riser plane, movement of the supported portion relative to the base portion about a yaw axis perpendicular to the riser plane and the tilt axis, and movement of the supported portion relative to the base portion about a slew axis parallel to the riser plane and perpendicular to the tilt axis and the yaw axis, and the articulating connector includes a restoring element, the restoring element being in an equilibrium standby condition when the supported portion is an initial position relative to the base portion, movement of the supported portion about the tilt axis relative to the base portion results in movement of the supported position out of its initial position relative to the base portion and subjects the restoring element to a loading that shifts the restoring element out of its equilibrium standby condition, and the restoring element operates with a bias to return to its equilibrium condition as a result of which the restoring element urges the supported portion to return to its initial condition relative to the base portion, the articulating connector compressing, extending, or both compressing and extending to permit movement of the supported portion relative to the base portion about the slew axis and to permit movement of the supported portion relative to the base portion about the tilt axis and the articulating connector permitting simultaneous movement of the supported portion relative to the base portion about the slew axis and about the tilt axis.

12. The riser system according to claim 11, wherein the supported portion includes a user engagement element, the user engagement element being at a spacing from the articulating connector in the riser direction, and the user engagement element extending laterally relative to the riser plane to the same one lateral side of the riser plane on which the base connection location is located.

13. The riser system according to claim 1, wherein the articulating connector is formed of an elastomeric material that is compressible and extendable.

14. The riser system according to claim 13, wherein the articulating connector includes a pin connecting the base portion to the articulating connector at the base connection location and a pin connecting the supported portion to the articulating connector at the riser connection location.

15. The riser system according to claim 1, wherein the articulating connector includes a pin connecting the base portion to the articulating connector at the base connection location and a pin connecting the supported portion to the articulating connector at the riser connection location.

16. The riser system according to claim 11, wherein the articulating connector is formed of an elastomeric material that is compressible and extendable.

17. The riser system according to claim 16, wherein the articulating connector includes a pin connecting the base portion to the articulating connector at the base connection location and a pin connecting the supported portion to the articulating connector at the riser connection location.

18. The riser system according to claim 9, wherein the articulating connector is configured as a triplanar pelvic articulation in the form of two rings, one within the other at a ninety degree(90°) offset.

19. The riser system according to claim 9, wherein the restoring element imparts a radially outward biasing force against a respective one of the rings and a movement of the supported portion and the base portion relative to one another about the tilt axis operates to compress the restoring element against the outward biasing force exerted by the restoring element on the respective ring, whereupon the restoring element urges the supported portion to return to its initial condition relative to the base portion.

* * * * *